US005736189A

United States Patent [19]

Bae

[11] Patent Number: 5,736,189

[45] Date of Patent: Apr. 7, 1998

[54] METHOD AND AN APPARATUS FOR FORMING A PHOSPHOR LAYER WITHIN A PROJECTION CCRT

[75] Inventor: Hyo Dae Bae, Daeku-si, Rep. of Korea

[73] Assignee: LG Electronics Inc., Seoul, Rep. of Korea

[21] Appl. No.: 529,737

[22] Filed: Sep. 18, 1995

[30] Foreign Application Priority Data

Sep. 16, 1994 [KR] Rep. of Korea ..... 23675/1994

[51] Int. Cl.[6] ..... B65D 5/06; B65C 3/00

[52] U.S. Cl. ..... 427/64; 427/73; 427/230; 427/377; 427/378; 427/443.2; 118/52; 118/58; 118/409

[58] Field of Search ..... 427/73, 64, 377, 427/378, 443.2, 230; 118/408, 58, 62

[56] References Cited

U.S. PATENT DOCUMENTS 2,676,110 4/1954 Hesse ..... 427/73
2,913,352 11/1959 Windsor ..... 427/73
2,982,669 5/1961 Stewart ..... 427/73
4,934,976 6/1990 Lane et al. ..... 427/73

*Primary Examiner*—Janyce Bell
*Attorney, Agent, or Firm*—Fish & Richardson PC

[57] ABSTRACT

A method and apparatus for forming a phosphor layer of a projection CCRT utilizes a sedimentation, in which phosphor particles forming a suspension are consistently precipitated and dried over the inner surface of a panel regardless of the particle sizes resulting in decreased porosity of the phosphor layer to improve brightness and resolution while reducing a working manufacturing time. The apparatus includes a supporter, a heating plate installed on the supporter for supporting and heating the integrally formed panel and funnel, a closing cap fitted into the end of a neck of the funnel for hermetically closing the inside of the panel and funnel from the outside, an air generator installed on the supporter for generating an air of high temperature, and an air guidance hose having an end inserted into the neck via the center of the closing cap for leading the air generated from the air generator into the inside of the panel and funnel, thereby precipitating the phosphor particles of the suspension injected into the inside of the panel and funnel by means of the air of high temperature under a predetermined pressure.

4 Claims, 3 Drawing Sheets

METHOD AND AN APPARATUS FOR FORMING A PHOSPHOR LAYER WITHIN A PROJECTION CCRT

BACKGROUND OF THE INVENTION

1. Field of the Invention

The present invention relates to a method and apparatus for forming a phosphor layer of a projection color cathode ray tube (hereinafter referred to as "projection CCRT"), and more particularly to a projection CCRT in which a phosphor layer is formed by a sedimentation method.

2. Description of the Prior Art

A projection CCRT is a CCRT generally used for projection, which is illustrated in FIG. 1. Here, a funnel 3 having a neck 2 on the rear portion thereof is integrally formed with a panel 1 to be externally shaped as a bulb. An electron gun 4 is housed within neck 2 for emitting three-color electron beams of red, green and blue. A deflection yoke 5 is installed along the outer circumference of neck 2 of funnel 3 for allowing the electron beams emitted from electron gun 4 to deflect in the horizontal and vertical directions. A phosphor layer 6 is formed on the inner surface of panel 1 for forming an image when the electron beams emitted from electron gun 4 and deflected by deflection yoke 5 collide thereon.

Since the above-described projection CCRT has integrally formed panel 1 and funnel 3, a sedimentation method should be utilized differently from the direct coating on the inner surface of a panel in forming a phosphor layer of a general CCRT in which a panel and a funnel are separated provided and then integrally formed by melting.

Therefore, a singular method for forming a phosphor layer is required in order to form phosphor layer 6 onto the inner surface of panel 1, and an apparatus for forming the phosphor layer is needed which is adapted to the method for forming the phosphor layer.

Typically, phosphor layer 6 has been heretofore formed on the inner surface of panel 1 forming the projection CCRT by utilizing a simple sedimentation and a rotational sedimentation.

In the simple sedimentation, as shown in FIG. 2, panel 1 integrally formed with funnel 3 is supported by a supporter 7, and a suspension (phosphor particles+pure water) is injected via neck 2 integrally formed with funnel 3 to fill up the inside of integrally formed panel 1 and funnel 3. Then, a predetermined time elapses while panel 1 and funnel 3 are filled with suspension. After the tire elapses, only the pure water is left since the phosphor particles forming the suspension precipitate onto the inner surface of panel 1. At this time, a worker discharges the remaining pure water via neck 2 formed with funnel 3 as one body, and dries the phosphor particles precipitated on the inner surface of panel 1, thereby completing the formation of phosphor layer 6 on the inner surface of panel 1.

In the rotational sedimentation, as shown in FIG. 3, panel 1 attached with funnel 3 by melting is supported by a rotational supporter 8, and a suspension (phosphor particles+pure water) is injected via neck 2 integrally formed with funnel 3 to fill up the inside of integrally formed panel 1 and funnel 3. Successively, a rotational force is produced by rotational-force generating unit (not shown) to relate the rotational supporter 8 at a predetermined angle with respect to the horizontal plane. Then, while the suspension filling panel 1 and funnel 3 flows within the inside, the phosphor particles forming the suspension precipitate onto the inner surface of panel 1, and thus only the pure water is left. At this time, a worker discharges the remaining pure water via neck 2 formed with funnel 3 as one body, and dries the phosphor particles precipitated on the inner surface of panel 1, thereby completing the formation of phosphor layer 6 on the inner surface of panel 1.

In connection with the conventional simple sedimentation and rotational sedimentation methods for forming the phosphor layer on the inner surface of the panel, however, the phosphor layer has a low density with a thick layer when the phosphor layer is formed by the simple sedimentation and the brightness and resolution are degraded. Thus, the simple sedimentation method is rarely utilized but the rotational sedimentation method is currently used. When the phosphor layer is formed via the rotational sedimentation, method large particles among the phosphor particles forming the suspension are primarily precipitated first by a difference of gravity, and the small particles are then precipitated. For this reason, the phosphor particles of the phosphor layer formed on the inner surface of the funnel form respective strata based on size as shown in FIG. 4, so that the phosphor particles involve air layers which, in turn, increases porosity to lower the brightness and resolution. Furthermore, the worker must wait until all phosphor particles are precipitated thereby lengthening the working time.

SUMMARY OF THE INVENTION

The present invention is devised to solve the above-described problem. Accordingly, it is an object of the present invention to provide a method and apparatus for forming a phosphor layer of a projection CCRT, in which a suspension is injected into the inside of an integrally formed panel and funnel, the panel and funnel are heated, and, at the same time, phosphor particles forming the suspension are precipitated and dried consistently over the inner surface of the panel regardless of the sizes of the phosphor particles when an air of high temperature is admitted within the panel and funnel. By this method, porosity is reduced, thereby improving brightness and resolution during use of the projection CCRT, and manufacturing time is reduced.

To achieve the above object of the present invention, there is provided a method for forming a phosphor layer of a projection CCRT, which is sequentially performed by the steps of supporting an integrally formed panel and funnel, and injecting a suspension into the inside of the integrally formed panel and funnel. Successively, the inside of the integrally formed panel and funnel is hermetically closed from the outside, and the integrally-formed and hermetically-closed panel and funnel are heated, and, at the same time, air of high temperature is supplied into the inside of the panel and funnel.

Also, an apparatus is provided for forming the phosphor layer of the projection CCRT which includes a supporter, and a heating plate installed on the supporter for supporting and heating the integrally formed panel and funnel. In addition, a closing cap is fitted into the end of a neck of the funnel for hermetically closing the inside of the panel and funnel from the outside, an air generator is installed on the supporter for generating an air of high temperature, and an air guidance hose having an end inserted into the neck via the center of the closing cap leads air of high temperature generated from the air generator into the inside of the panel and funnel. Therefore, the phosphor particles of the suspension injected into the inside of the panel and funnel are precipitated over the inner surface of the panel by the air of high temperature under a predetermined pressure.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

A method and apparatus for forming a phosphor layer of a CCRT according to the present invention will be described with reference to FIGS. 5 and 6.

Figure 1:
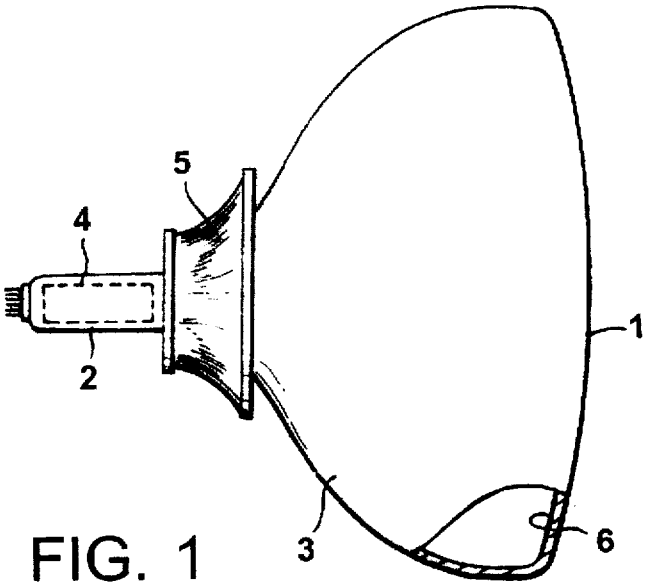
FIG. 1 shows an external appearance of a projection CCRT.
Figure 2:
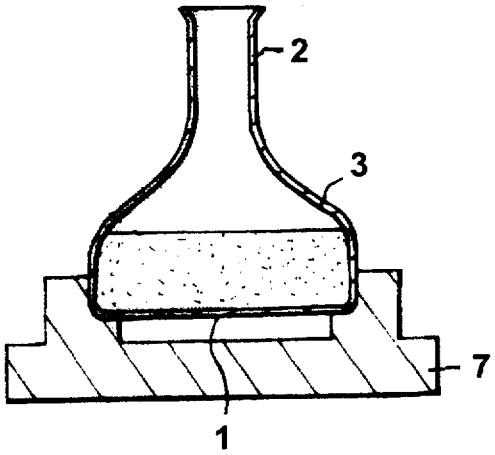
FIG. 2 is a front view showing a state of forming the phosphor layer by means of a conventional simple sedimentation.
Figure 3:
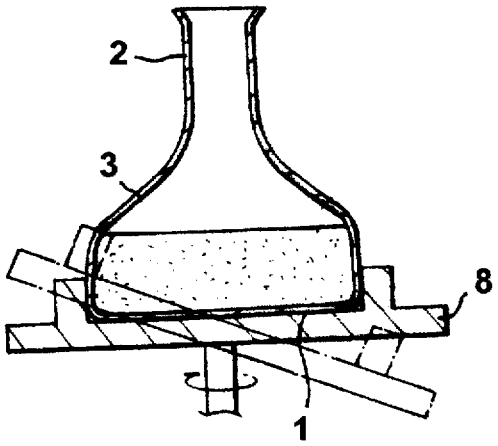
FIG. 3 is a front view showing a state of forming the phosphor layer by means of a conventional rotational sedimentation.
Figure 4:
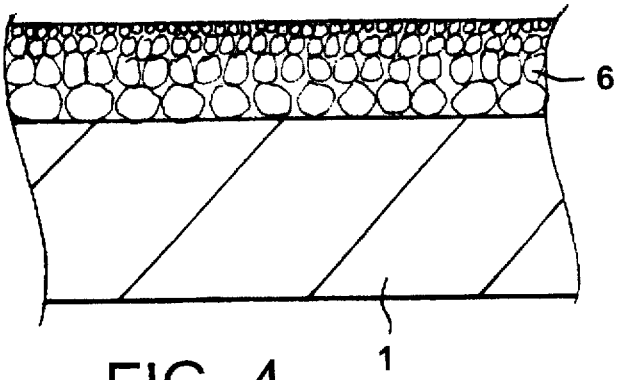
FIG. 4 is a vertically section view showing the phosphor layer formed by the conventional rotational sedimentation.
Figure 5:
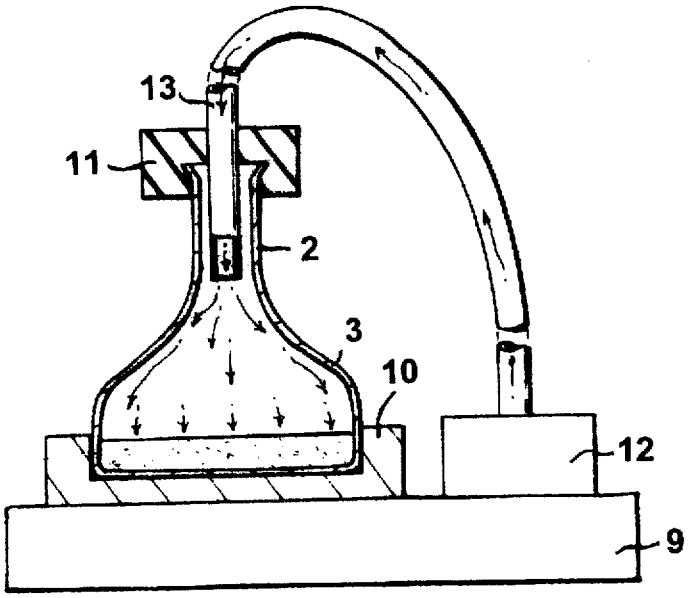
FIG. 5 is a front view showing a state of forming a phosphor layer according to the present invention.
Figure 6:
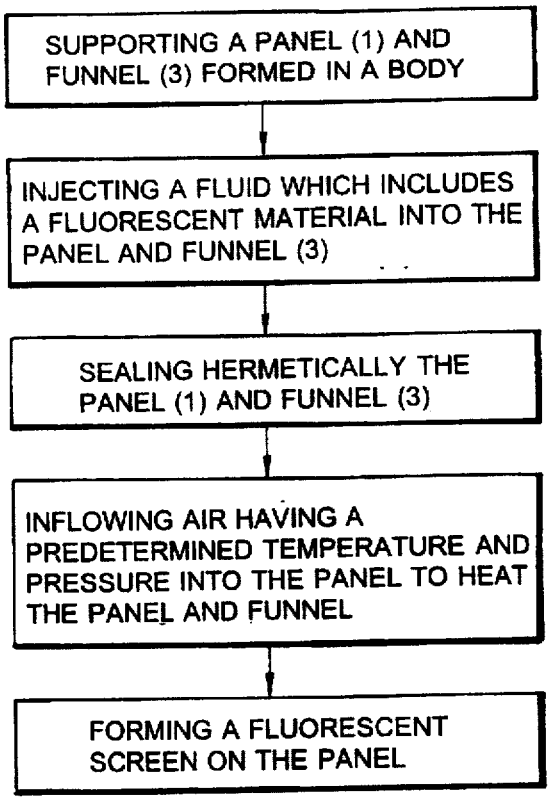
FIG. 6 is a flowchart for forming the phosphor layer according to the present invention.

FIG. 5 illustrates a state of forming the phosphor layer according to the present invention, and FIG. 6 is a flowchart for showing a process of forming the phosphor layer. In the present invention, a heating plate 10 is installed onto the upper plane of a supporter 9 to permit heating plate 10 to support an integrally formed panel 1 and funnel 3. Under this state, panel 1 and funnel 3 are heated, and a closing cap 11 is fitted into the end of a neck 2 of funnel 3 supported by heating plate 10 to hermetically close the inside from the outside of the integrally formed panel 1 and funnel 3. An air generator 12 is installed to one side of the upper portion of supporter 9 to generate air of high temperature. Neck 2 of funnel 3 is inserted with the end of an air guidance hose 13 via center of closing cap 11, so that the air of high temperature generated from air generator 12 is led by air guidance hose 13 to be admitted into the inside of integrally formed panel 1 and funnel 3.

Therefore, under the state that integrally formed panel 1 and funnel 3 are supported by heating plate 10 installed onto the upper plane of supporter 9, a suspension is injected into the inside of panel 1 and funnel via neck 2 which is formed with funnel 3 as one body, and closing cap 11 is fitted to the end of neck 2, thereby hermetically closing the inside of integrally formed panel 1 and funnel 3 from the outside by means of closing cap 11.

Then, once integrally formed panel 1 and funnel 3 are heated by heating plate 10 while operating air generator 12, the air of high temperature from air generator 12 is led by air guidance hose 13 to be admitted into the inside of panel 1 and funnel 3. Consequently, the phosphor particles forming the suspension are deposited onto the inner surface of panel 1 to form a phosphor layer 6. Here, the temperature of the air admitted to the inside of integrally formed panel 1 and funnel 3 after being generated from air generator 12 and led by air guidance hose 13 is preferably 40°–60° C., and the pressure thereof is preferably 0.05–1 Kg/cm$^2$.

If the air pressure admitted into the inside of panel 1 and funnel 3 is lower than 0.05 Kg/cm$^2$, the phosphor particles of the suspension deposited by the air pressure are deposited slowly lengthening the manufacturing time. If the air pressure is higher than 1 Kg/cm$^2$, the phosphor particles of the suspension are deposited too fast as to speed up the manufacturing time, the process will result in a deposition state.

Also, when the air temperature admitted into the inside of panel 1 and funnel 3 is lower than 40° C., as will be described later, the drying operation for evaporating the pure water to dry the deposited phosphor particles by the heating of heating plate 10 takes too much time. If it is higher than 60° C., the drying operation takes too short a time, so that the dried phosphor particles are separated from one another.

Thereafter, only the pure water is left when the phosphor particles forming the suspension are deposited onto the inner surface of panel 1. Since the pure water is evaporated by the temperature of the air admitted within panel 1 and funnel 3 and the temperature transmitted by heating plate 10 to panel 1 and funnel 3, the forming of phosphor layer 6 is completed.

Figure 7:
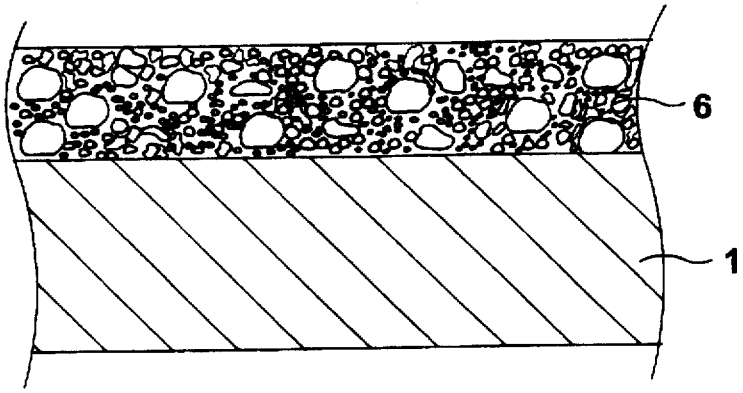
FIG. 7 is a vertically section view showing the phosphor layer formed according to the present invention.

The phosphor particles forming the suspension are deposited on the inner surface of the panel by the pressure of the air of high temperature to form the phosphor layer, so that the large particles and small particles of the phosphor particles are consistently mixed as shown in FIG. 7 when forming the phosphor layer. As a result, the phosphor layer has high density and forms a thin layer with decreased porosity, thereby greatly improving brightness and resolution of the CCRT and reducing the manufacturing time.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A method for forming a phosphor layer of a projection cathode ray tube, the method comprising the steps of:

supporting an integrally formed panel and funnel of the cathode ray tube;

injecting a phosphor suspension into an inside of the integrally formed panel and funnel of the cathode ray tube;

hermetically closing the inside of the integrally formed panel and funnel of the cathode ray tube from outside the cathode ray tube; and heating the integrally-formed and hermetically-closed panel and funnel of the cathode ray tube, and, at the same time, supplying heated air into the inside of the panel and funnel.

2. An apparatus for forming a phosphor layer of a projection cathode ray tube having an integrally formed panel and funnel with a neck, the apparatus comprising:

a supporter for supporting the cathode ray tube;

a heating plate installed on said supporter for heating the integrally formed panel and funnel of the cathode ray tube;

a closing cap configured to be fitted into an end of the neck of the funnel for hermetically closing an inside of the cathode ray tube from outside the cathode ray tube;

an air generator installed on said supporter for generating heated air under a predetermined pressure; and an air guidance hose having an end configured to be inserted into the neck via a center of said closing cap for leading said air generated from said air generator into the inside of the cathode ray tube.

3. An apparatus for forming a phosphor layer of a projection cathode ray tube as claimed in claim 2, wherein the apparatus is configured to control the temperature of said air generated from said air generator and led by said air guidance hose to be admitted into the inside of the panel and funnel to fall within the range of 40°–60° C.

4. An apparatus for forming a phosphor layer of a projection cathode ray tube as claimed in claim 2, wherein the apparatus is configured to control the pressure of said air generated from said air generator and led by said air guidance hose to be admitted into the inside of the panel and funnel to fall within the range of 0.05–1 $Kg/cm^2$.

* * * * *